US010655646B2

(12) United States Patent
Chen et al.

(10) Patent No.: US 10,655,646 B2
(45) Date of Patent: May 19, 2020

(54) COMPRESSED GAS SUPPLIER FOR A PNEUMATIC TOOL

(71) Applicant: BANZA STAMPING INDUSTRY CORP., Suao Township, Yilan County (TW)

(72) Inventors: Li-Wei Chen, Suao Township, Yilan County (TW); Cole Krebs, Suao Township, Yilan County (TW)

(73) Assignee: BANZA STAMPING INDUSTRY CORP., Suao Township (TW)

( * ) Notice: Subject to any disclaimer, the term of this patent is extended or adjusted under 35 U.S.C. 154(b) by 0 days.

(21) Appl. No.: 16/148,077

(22) Filed: Oct. 1, 2018

(65) Prior Publication Data

US 2020/0102972 A1 Apr. 2, 2020

(51) Int. Cl.
*F15B 1/26* (2006.01)

(52) U.S. Cl.
CPC ..... *F15B 1/265* (2013.01); *Y10T 137/7808* (2015.04)

(58) Field of Classification Search
CPC ..... Y10T 137/7808; Y10T 137/86187; Y10T 137/8622
USPC ..... 173/208
See application file for complete search history.

(56) References Cited

U.S. PATENT DOCUMENTS 3,721,095 A * 3/1973 Chelminski ..... E02D 7/00 405/232
4,481,969 A * 11/1984 Fallon ..... F16K 17/00 137/116.5
4,898,205 A * 2/1990 Ross ..... F17C 13/04 137/505.12
2003/0173098 A1* 9/2003 Miner ..... B25D 9/06 173/200
2004/0154668 A1* 8/2004 Larsen ..... F16K 1/305 137/505.25
2007/0034395 A1* 2/2007 Glaser ..... B44B 5/00 173/30
2011/0155267 A1* 6/2011 Nicolini ..... F17C 13/04 137/511
2014/0124062 A1* 5/2014 Mayr ..... F16K 17/065 137/505

FOREIGN PATENT DOCUMENTS

CN 100445043 C 2/2008
TW I444560 B 7/2014
WO 2014/0193333 A1 2/2014

* cited by examiner

*Primary Examiner* — Robert K Arundale
(74) *Attorney, Agent, or Firm* — Patenttm.us; James Walters

(57) ABSTRACT

A compressed gas supplier has a power-free decompression device and an expansion chamber. The power-free decompression device decompresses a gas in a high-pressure source into a decompressed gas. The expansion chamber connects to the power-free decompression device and receives and stores the decompressed gas. The pneumatic tool is driven by the decompressed gas in the expansion chamber. Thus, the compressed gas supplier for the pneumatic tool is small and easy to be carry. In addition, the decompressed gas stored in the expansion chamber is also benefit for supplying decompressed gas to the pneumatic tool that needs much gas to drive.

12 Claims, 12 Drawing Sheets

COMPRESSED GAS SUPPLIER FOR A PNEUMATIC TOOL

BACKGROUND OF THE INVENTION

1. Field of the Invention

The present invention relates to a compressed gas supplier, especially to a compressed gas supplier for a pneumatic tool.

2. Description of the Prior Arts

Pneumatic tools are widely used and are driven by compressed air. Comparing with the electric power tools, the pneumatic tools are safer to operate and to maintain since there is no risk of sparks, short circuit, electrocution and so on. The compressed air is usually provided by an air compressor. However, the air compressor is heavy and takes a certain space. When the user needs to work at places that are not convenient for bringing such a heavy and large things such as working at height or narrow places, the user cannot use the air compressor. Then the user may have to give up the pneumatic tools and prepare the electric power tools for working in such places. Preparing both the pneumatic tools and the electric power tools is not economic for the users. Therefore, the conventional way to supply the compressed air to the pneumatic tools needs to be modified.

To overcome the shortcomings, the present invention provides a compressed gas supplier for a pneumatic tool to mitigate or to obviate the aforementioned problems.

SUMMARY OF THE INVENTION

The present invention provides a compressed gas supplier for a pneumatic tool. The compressed gas supplier has a power-free decompression device and an expansion chamber. The power-free decompression device decompresses a gas in a high-pressure source into a decompressed gas. The expansion chamber connects to the power-free decompression device and receives and stores the decompressed gas. The pneumatic tool is driven by the decompressed gas in the expansion chamber. Thus, the compressed gas supplier for the pneumatic tool is small and easy to be carry. In addition, the decompressed gas stored in the expansion chamber is also benefit for supplying decompressed gas to the pneumatic tool that needs much gas to drive.

Other objectives, advantages and novel features of the invention will become more apparent from the following detailed description when taken in conjunction with the accompanying drawings.

DETAILED DESCRIPTION OF THE EMBODIMENTS

Figure 1:
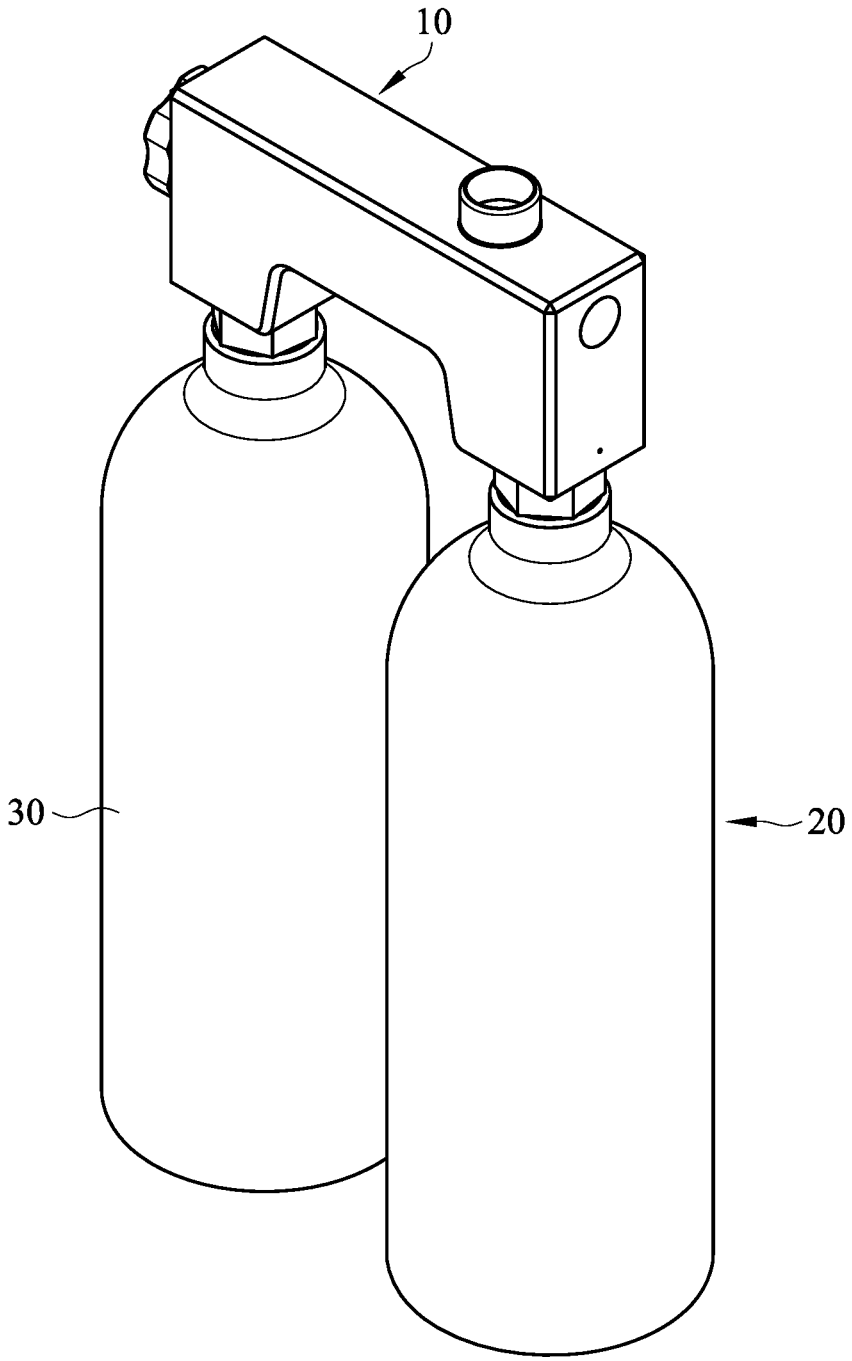
FIG. 1 is a perspective view of a compressed gas supplier for a pneumatic tool in accordance with the present invention.
Figure 2:
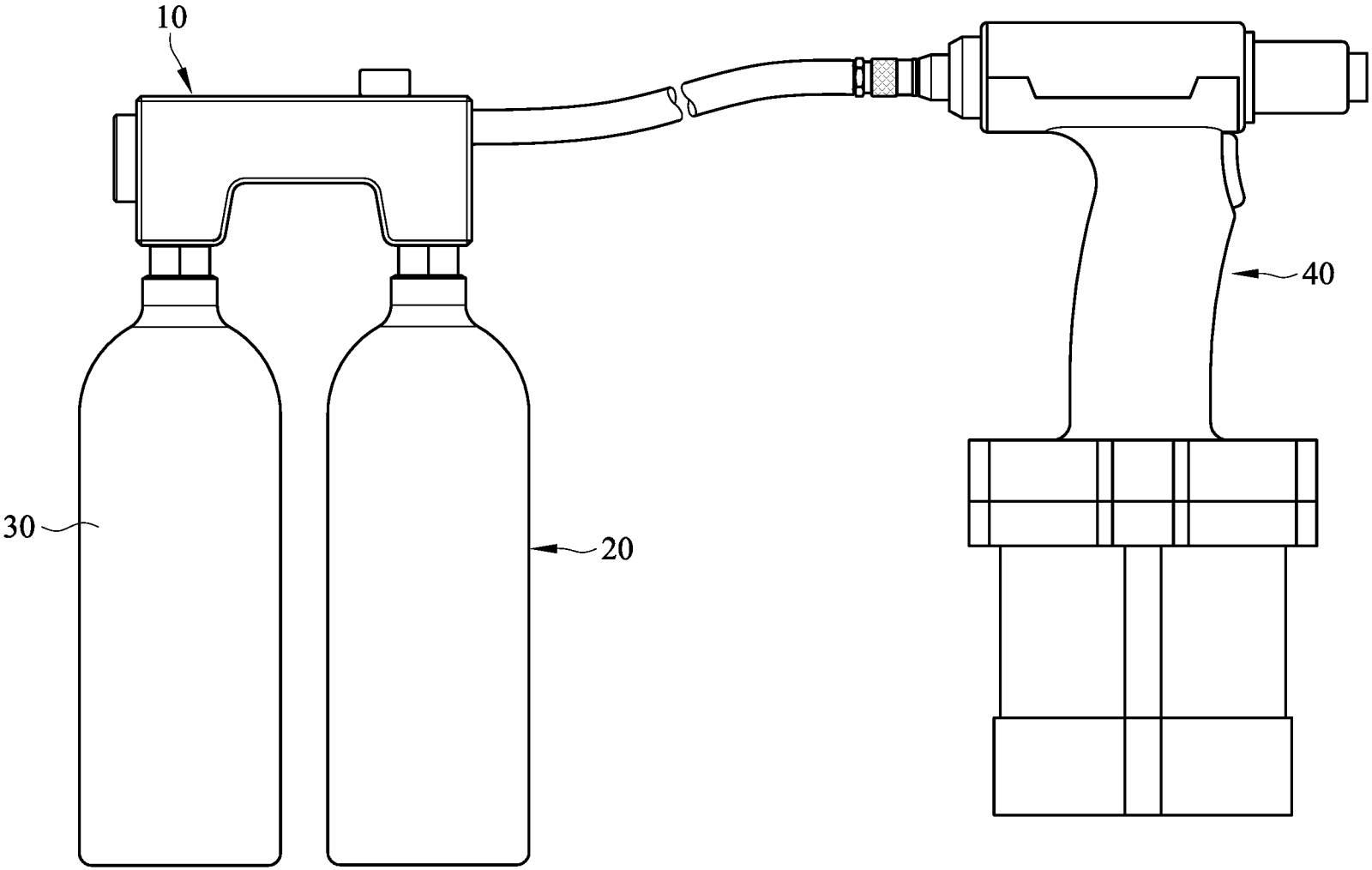
FIG. 2 is an operational front view of the compressed gas supplier in FIG. 1 with a pneumatic tool.

With reference to FIGS. 1 and 2, a compressed gas supplier for a pneumatic tool in accordance with the present invention comprises a power-free decompression device 10 and an expansion chamber 20.

The power-free decompression device 10 connects to a high-pressure source 30 to decompress the gas in the high-pressure source 30 into a decompressed gas that is at the desired pressure for the pneumatic tool 40. For example, the pressure of the gas in the high-pressure source 30 may be 3000 psi, and the desired pressure for the pneumatic tool 40 may be 90 psi. The expansion chamber 20 connects to the power-free decompression device 10 to receive and to preserve the decompressed gas. Then the decompressed gas is output from the expansion chamber 20 to a pneumatic tool 40 so that the pneumatic tool 40 can be driven by the decompressed gas. In one embodiment, the power-free decompression device 10 may be a regulator.

Figure 3:
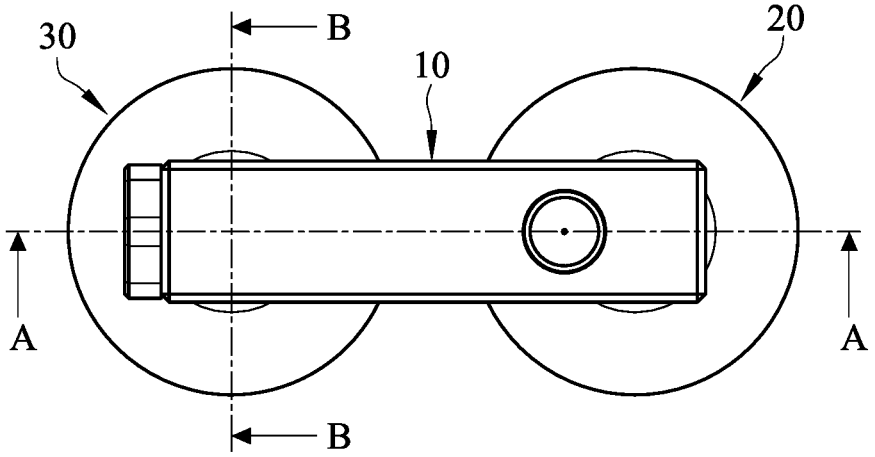
FIG. 3 is a top view of the compressed gas supplier in FIG. 1.
Figure 4:
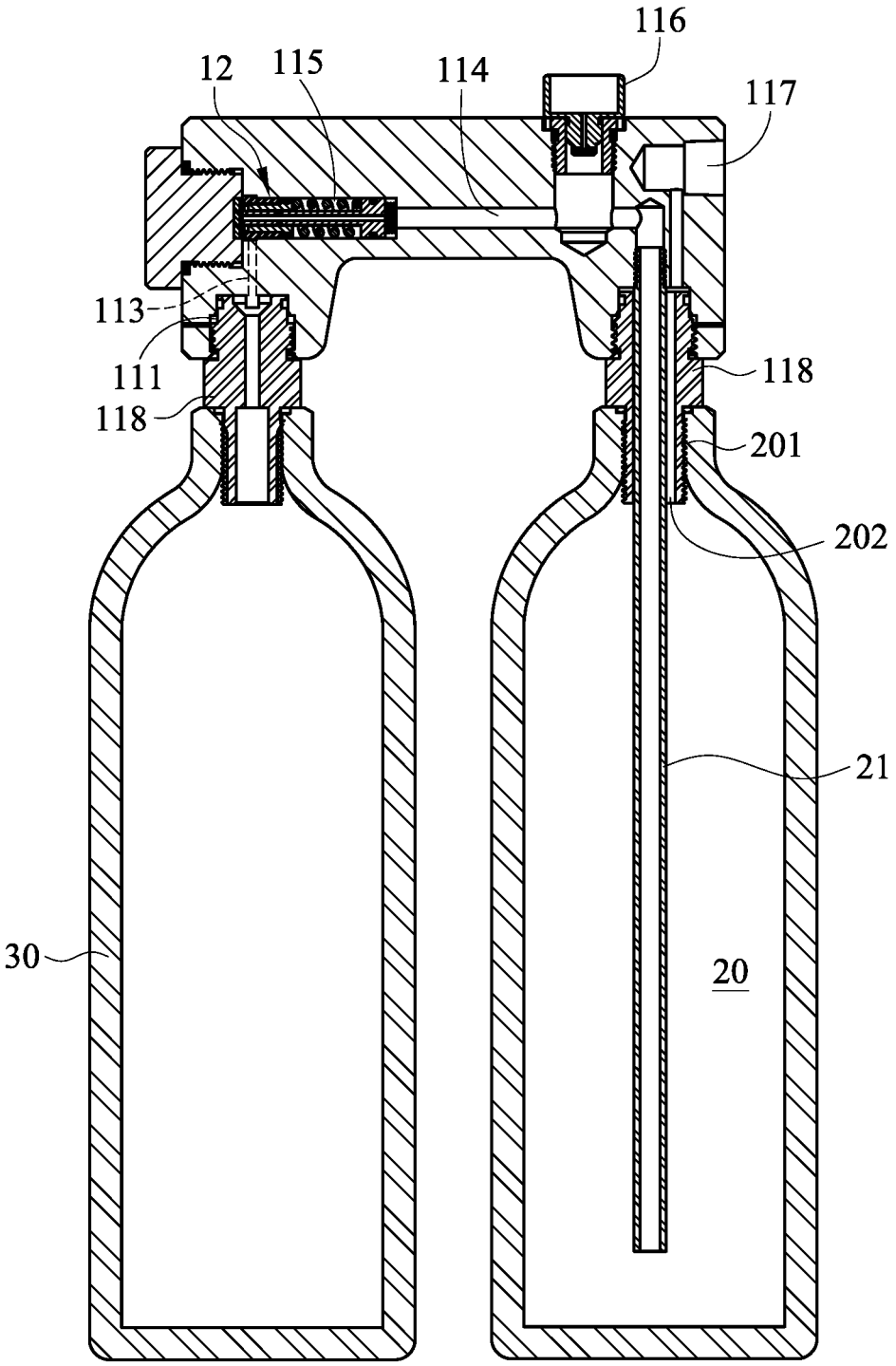
FIG. 4 is a cross-sectional view of the compressed gas supplier along line A-A in FIG. 3.

With further reference to FIGS. 3 and 4. in one embodiment, power-free decompression device 10 may comprise a shell 11 and a decompression assembly 12.

Figure 5:
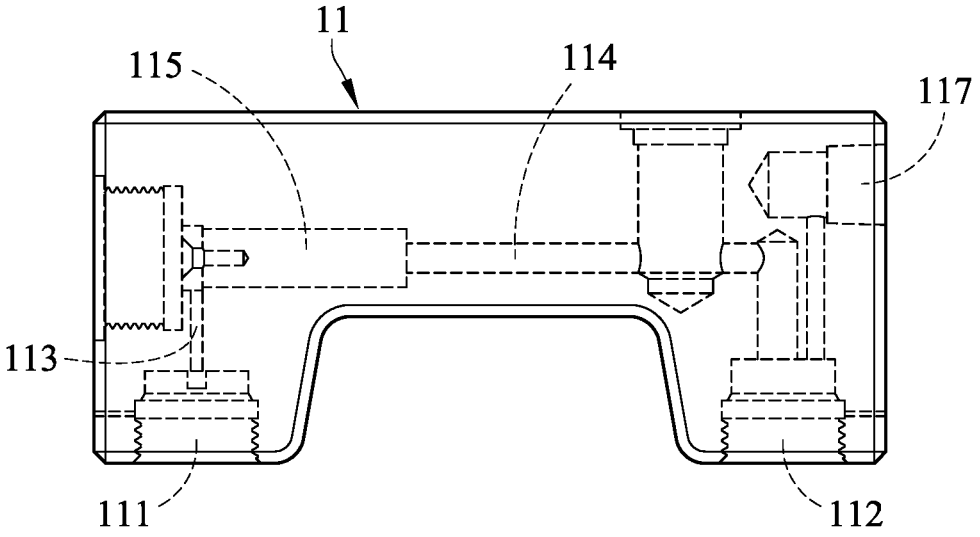
FIG. 5 is a front view of a housing of the compressed gas supplier in FIG. 1.
Figure 6:
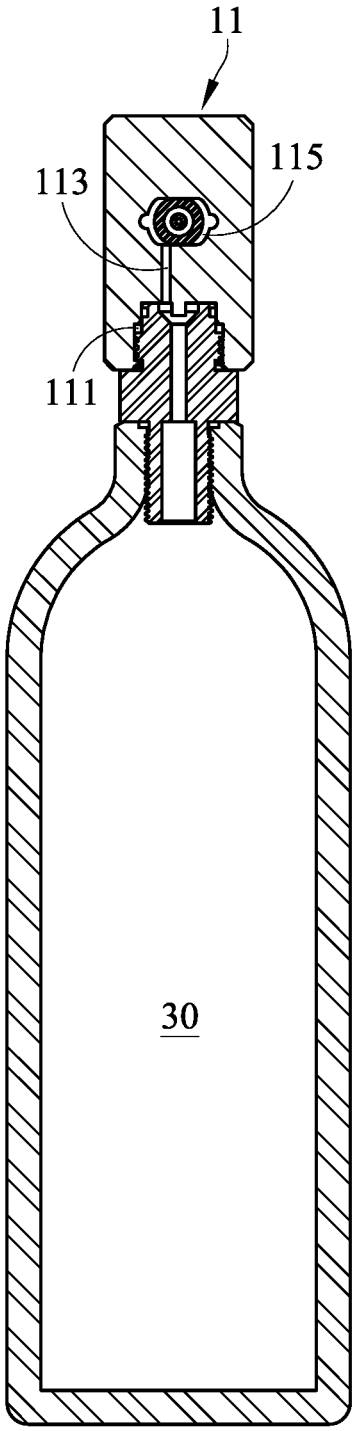
FIG. 6 is a cross-sectional view of the compressed gas supplier along line B-B in FIG. 3.

With reference to FIGS. 3, 5 and 6, the housing 11 has an inlet 111, an outlet 112, an inlet channel 113, an outlet channel 114 and a decompression room 115. The inlet channel 113 and the outlet channel 114 are formed inside the housing 11. The inlet channel 113 communicates with the inlet 111. The outlet channel 114 communicates with the outlet 112. The decompression room 115 is formed inside the housing 11 and is formed between and communicates with the inlet channel 113 and the outlet channel 114. In one embodiment, a pressure meter 116 is mounted through the housing 11 and extends into the outlet channel 114 to measure the gas pressure in the outlet channel 114 so that the user may monitor the gas pressure of the output gas.

Figure 7:
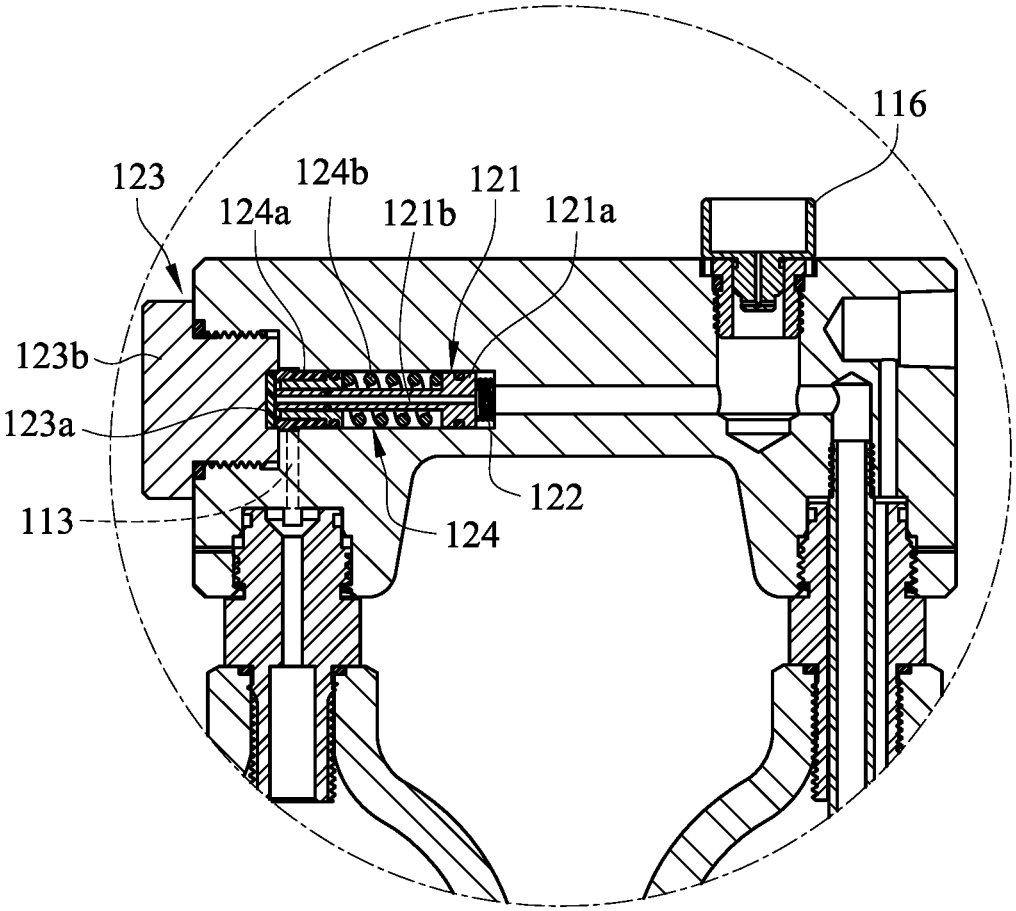
FIG. 7 is an enlarged view of the compressed gas supplier in FIG. 4.
Figure 8:
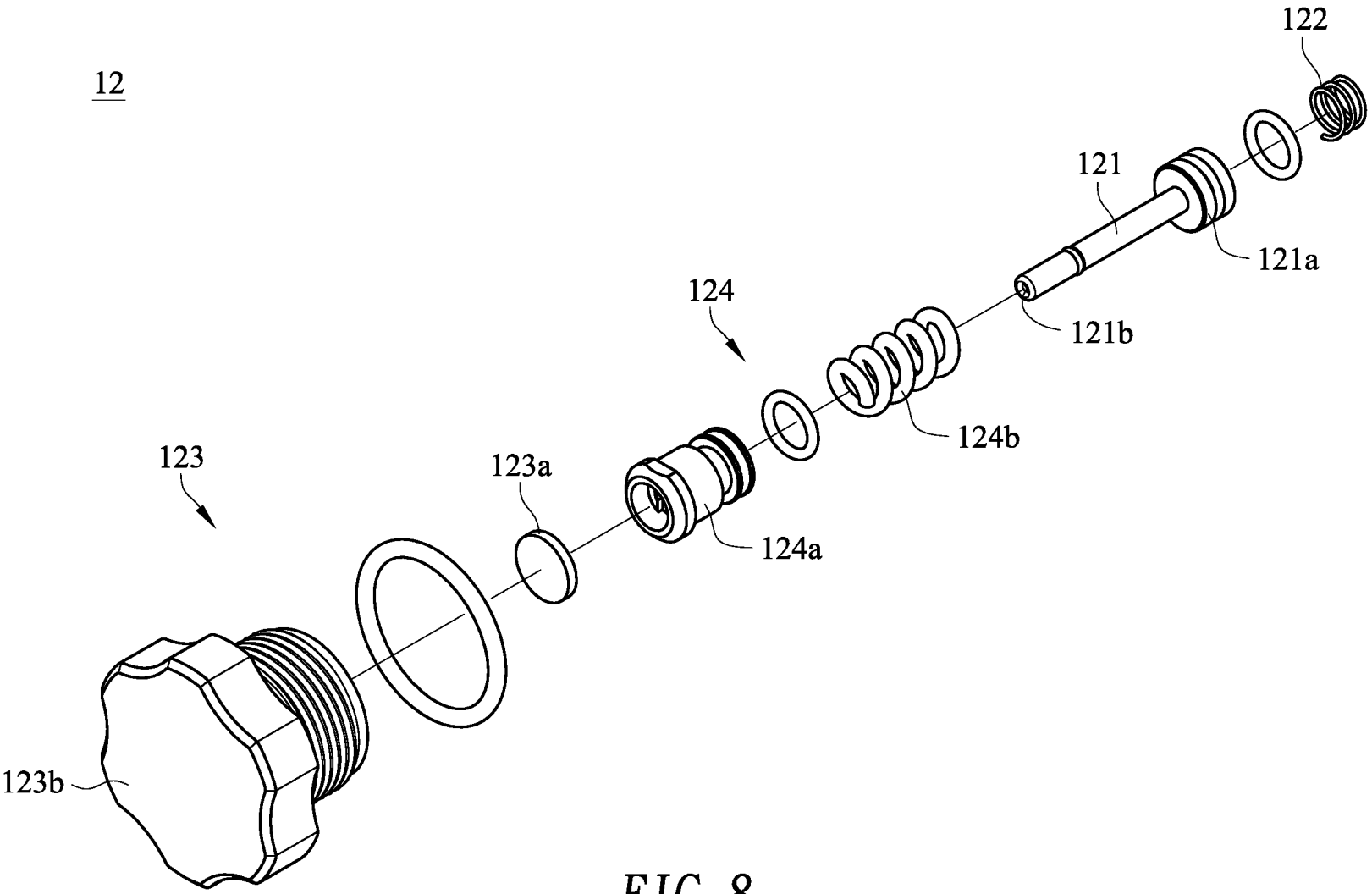
FIG. 8 is an exploded perspective view of a decompression assembly of the compressed gas supplier in FIG. 1.

With reference to FIGS. 7 and 8, the decompression assembly 12 is mounted in the decompression room 115 of the housing 11, selectively blocks the communication between inlet channel 113 and the decompression room 115, and comprises a piston 121, a first resilient member 122, a sealing member 123 and an optional pressure setting member 124.

The piston 121 is mounted slidably in the decompression room 115, selectively blocks the communication between inlet channel 113 and the decompression room 115, and has a first end, a second end, a head 121*a*, and a central opening 121*b*. The head 121*a* is formed on the second end of the piston 121 and has a first side and a second side. The central opening 121*b* is formed through the first and second ends, selectively communicates with the inlet channel 113 and communicates with the outlet channel 114.

The first resilient member 122 is mounted in the decompression room 115 and abuts against the second side of the head 121*a* to push the piston 121 to slide away from the outlet channel 114.

The sealing member 123 is mounted in the decompression room 115 and selectively abuts against the first end of the piston 121 to selectively block the communication between inlet channel 113 and the decompression room 115. In one embodiment, the sealing member 123 comprises a washer 123*a* and a screw 123*b*. The washer 123*a* selectively abuts against the first end of the piston 121 to selectively block the communication between inlet channel 113 and the decompression room 115. The screw 123*b* is mounted through the housing 11, holds the washer 123*a* to selectively moves the washer 123*a* axially.

The pressure setting unit 124 is mounted in the decompression room 115, is clamped between the piston 121 and the sealing member 123 to selectively block the communication between inlet channel 113 and the decompression room 115. In one embodiment, the pressure setting member 124 comprises an adjusting element 124*a* and a second resilient member 124*b*. The adjusting element 124*a* selectively abuts against the sealing member 123 to selectively block the communication between inlet channel 113 and the decompression room 115. The second resilient member 124*b* is clamped between the adjusting element 124*a* and the first side of the head 121*a* of the piston 121 to push the adjusting element 124*a* to abut against the sealing member 123.

In one embodiment, the first and second resilient elements 122, 124*b* may be springs, a plurality of resilient washers and so on. In one embodiment, a plurality of airproof elements may be mounted in the decompression room 115 to keep the gas from leaking. The airproof elements may be O-rings and may be mounted around the piston 121 and the pressure setting member 124.

With reference to FIGS. 1 and 4, in one embodiment, the expansion chamber 20 has a first end, a second end, an entry 201 and a releasing hole 202. The entry 201 is formed on the first end of the expansion chamber 20 and communicates with the outlet 112 of the housing 11. The releasing hole 202 is formed on the first end of the expansion chamber 20. The housing 11 may have a releasing channel 117 formed on the housing 11 and communicates with the releasing hole 202 of the expansion chamber 20. The pneumatic tool 40 connects to the releasing channel 117 to receive the decompressed gas.

Since the entry 201 and the releasing hole 202 are both on the first end of the expansion chamber 20, the decompressed gas may directly flow out the releasing hole 202 without entering deeper into the expansion chamber 20. If the high-pressure source 30 provides some gas that contains liquid after decompressing such as carbon dioxide, the aforementioned flow path may cause the liquid to enter the pneumatic tool 40. Thus, an elongated tube 21 may connects to and communicates with the outlet 112 of the housing 11, protrudes through the entry 201 and protrudes toward the second end of the expansion chamber 20. Thus, the decompressed gas output from the outlet 112 of the housing 11 flows through the elongated tube 21 to be distant from the releasing hole 202.

Figure 9:
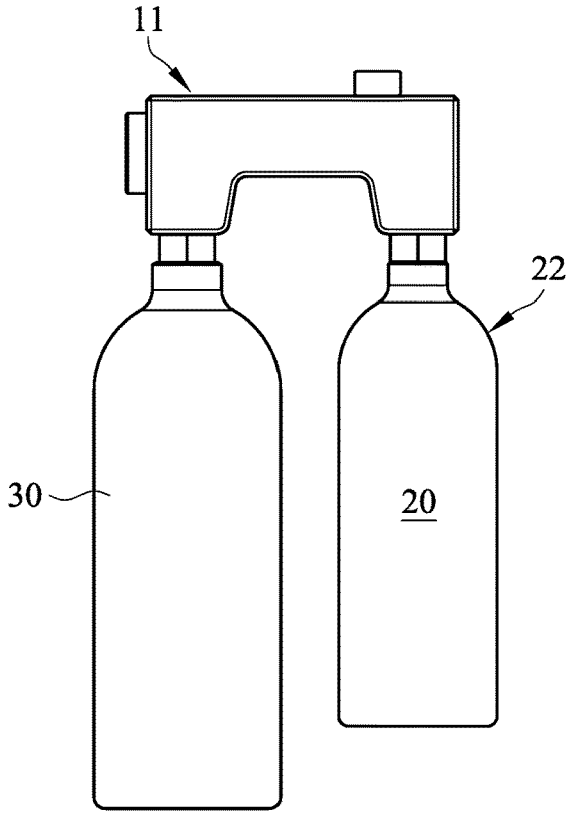
FIG. 9 is a front view of another embodiment of the compressed gas supplier in accordance with the present invention.
Figure 10:
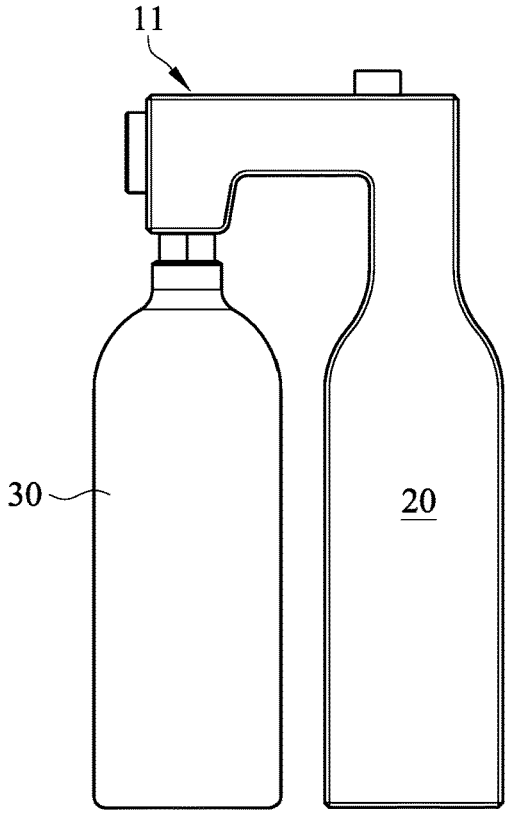
FIG. 10 is a front view of still another embodiment of the compressed gas supplier in accordance with the present invention.

The expansion chamber 20 may have different embodiments. In one embodiment as shown in FIG. 9, the expansion chamber 20 is defined in a detachable bottle 22, and the user may choose different sizes of the bottle 22 as desired. In one embodiment as shown in FIG. 10, the expansion chamber 20 is formed on the housing 11.

With reference to FIG. 4, in one embodiment, the housing 11 may connect to the high-pressure source 30 and the expansion chamber 20 through connectors 118.

With reference to FIGS. 4 and 8, when the high-pressure source 30 is not connected yet, the piston 121 is pushed by the first resilient element 122 to abut against the washer 123*a* of the sealing member 123, and the adjusting element 124*a* is also pushed by the second resilient element 124*b* to abut against the washer 123*a* of the sealing member 123. At this status, the communication between the inlet channel 113 and the decompression room 115 is blocked.

Figure 11A:
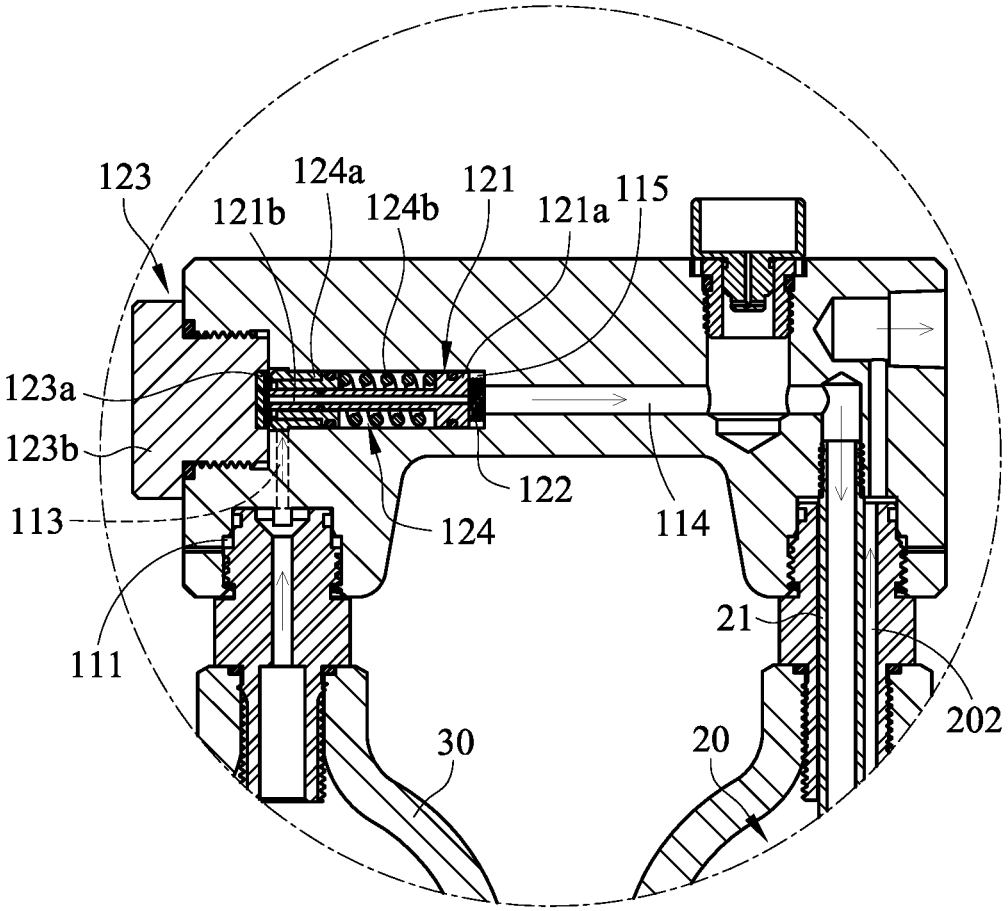
FIG. 11A is an operational enlarged cross-sectional view of the compressed gas supplier in FIG. 4, shown the piston and the adjusting element sliding right.
Figure 11B:
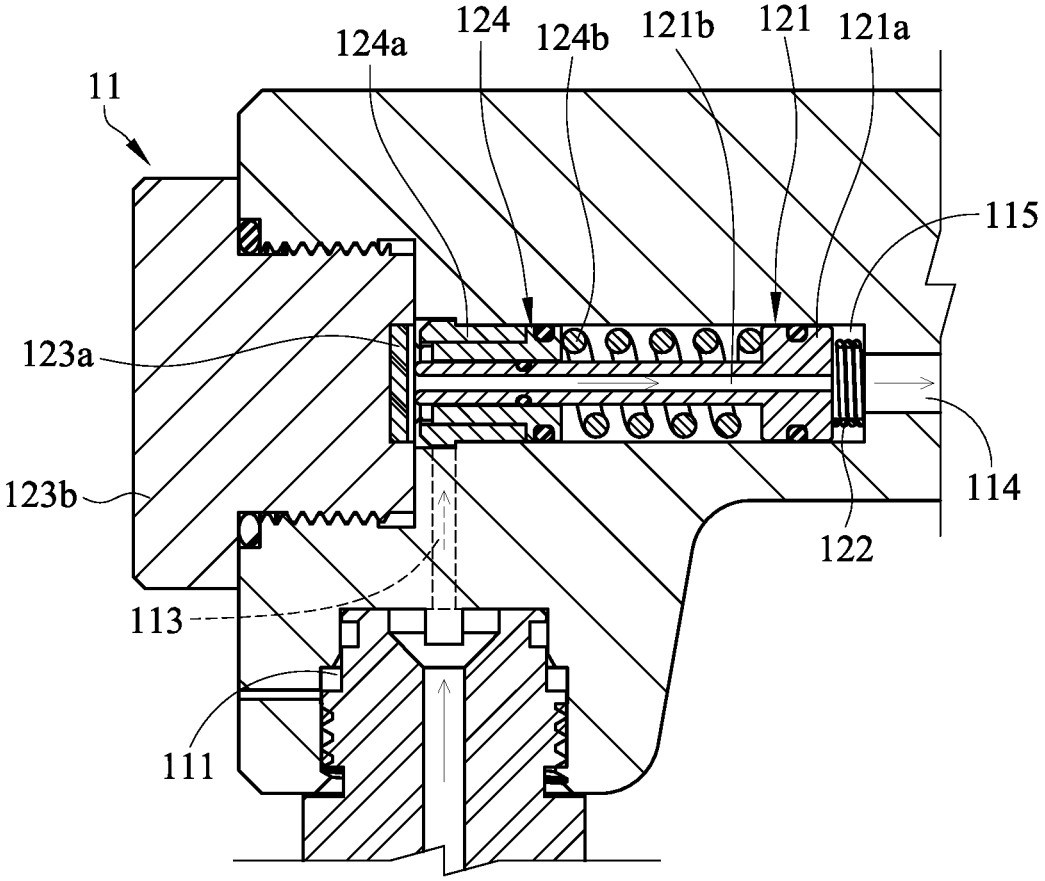
FIG. 11B is an enlarged view of the compressed gas supplier in FIG. 11A.

With reference to FIGS. 11A and 11B, when the high-pressure source 30 is connected to the inlet 111 of the housing 11, the high-pressure gas inside the high-pressure source 30 pushes the adjusting element 124*a* to slide axially so that the adjusting element 124*a* leaves the washer 123*a* to allow the high-pressure gas flow into the decompression room 115. Then the high-pressure gas pushes the piston 121 to slide axially so that the piston 121 leaves the washer 123*a* to allow the high-pressure gas flow into the central opening 121*b* of the piston 121. Thus, the high-pressure gas flows through the central opening 121*b* and the outlet channel 114 and is stored in the expansion chamber 20.

Since the second resilient element 124*b* provide predetermined resilient force, the adjusting element 124*a* are pushed back by the gas in the outlet channel 114 when the pressure of the gas in the outlet channel 114 and the expansion chamber 20 adding the predetermined resilient force of the second resilient element 124*b* is larger than the pressure in the high-pressure source 30, which is shown in FIGS. 4 and 7. Then the gas flowing from the high-pressure source 30 is blocked again so that no gas pushes the piston 121. Thus, the piston 121 is pushed back by the first resilient element 122.

Figure 12:
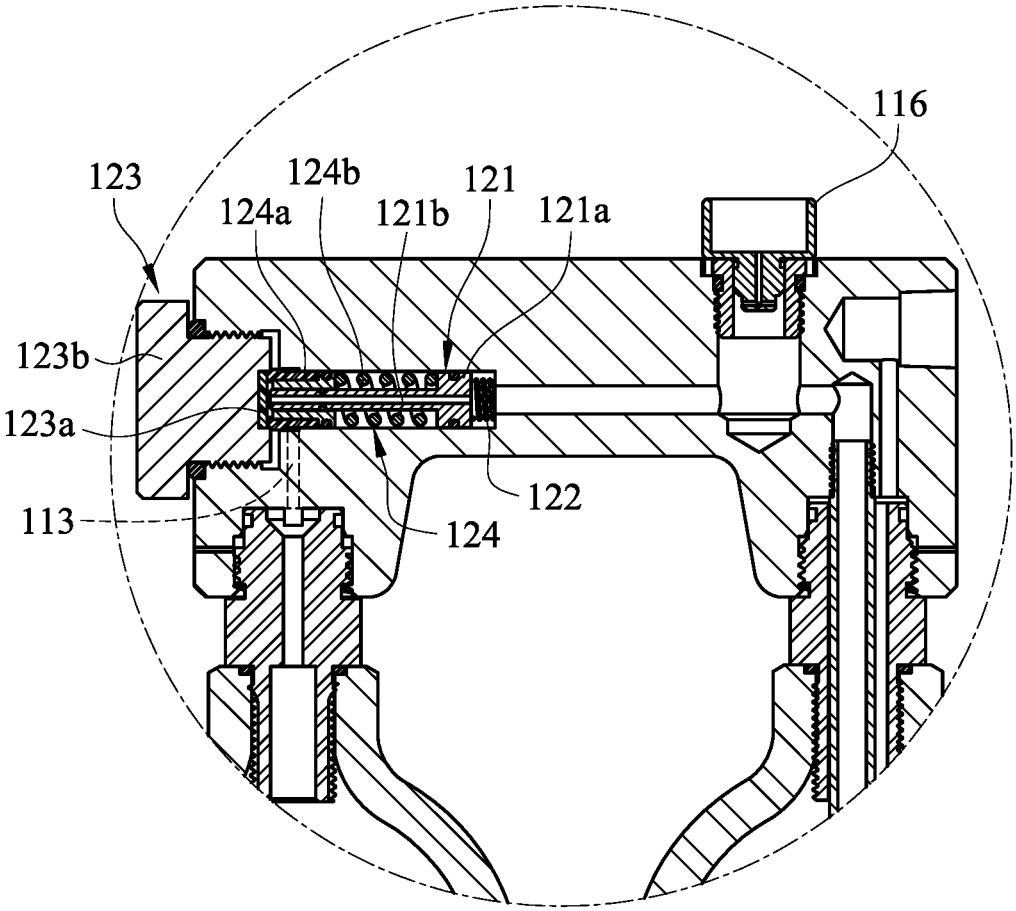
FIG. 12 is an operational enlarged cross-sectional view of the compressed gas supplier in FIG. 4, shown the screw is screwed left.

The desired pressure of the gas in the expansion chamber 20 may be different according to the need of the pneumatic tool 40. The screw 123*b* may be screwed deeper or shallower to adjust the pressure of the gas in the expansion chamber 20. When the screw 123*b* is screwed deeper or shallower, the axial position of the washer 123*a* is adjusted so that the initial position of the adjusting element 124*a* is changed accordingly. Then the predetermined resilient force of the second resilient element 124*b* is changed accordingly. With reference to FIG. 7, the screw 123*a* is screwed deeper into the housing 11. The second resilient element 124*b* is compressed more to provide larger predetermined resilient force so that the required pressure in the expansion chamber 20 is smaller. With reference to FIG. 12, the screw 123*a* is screwed shallower into the housing 11. The second resilient element 124*b* is compressed less to provide smaller predetermined resilient force so that the required pressure in the expansion chamber 20 is larger.

In another embodiment, the decompression assembly 12 may not comprise the pressure setting member 124. The desired pressure of the gas in the expansion chamber 20 may be determined by the first resilient element 122.

The compressed gas supplier in accordance with the present invention has the following advantages. With the compressed gas supplier as described, carrying the high-pressure source 30 and the compressed gas supplier as described is enough to provide sufficient pneumatic power to the pneumatic tool 40. Since the high-pressure source 30 and the compressed gas supplier as described are way smaller and lighter than an air compressor, the user could use the pneumatic tool 40 with the high-pressure source 30 and the compressed gas supplier as described at much more places that may be high, narrow or small. Moreover, since some pneumatic tool 40 needs much gas to drive the decompressed gas is enough to drive the pneumatic tool 40 with the expansion chamber 20 to store the decompressed gas.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A compressed gas supplier for a pneumatic tool comprising:

a power-free decompression device decompressing a gas in a high-pressure source into a decompressed gas, and comprising a housing having an inlet connecting to the high-pressure source;

an outlet;

an inlet channel formed inside the housing and communicating with the inlet;

an outlet channel formed inside the housing and communicating with the outlet;

a decompression room formed inside the housing, and formed between and communicating with the inlet channel and the outlet channel; and a releasing channel formed on the housing; and a decompression assembly mounted in the decompression room of the housing, and selectively blocking the communication between inlet channel and the decompression room; and an expansion chamber connecting to the power-free decompression device and receiving and storing the decompressed gas to adapted for selectively supplying the decompressed gas to the pneumatic tool, and having a first end;

a second end;

an entry formed on the first end of the expansion chamber and communicating with the outlet of the housing; and a releasing hole formed on the expansion chamber and communicating with the releasing channel of the housing to adapted for connecting to the pneumatic tool.

2. The compressed gas supplier as claimed in claim 1, wherein the decompression assembly comprises:

a piston mounted slidably in the decompression room, selectively blocking the communication between inlet channel and the decompression room, and having a first end;

a second end; and a central opening formed through the first and second ends, selectively communicating with the inlet channel, and communicating with the outlet channel;

a first resilient element mounted in the decompression room and abutting against the second end of the piston to push the piston to slide away from the outlet channel; and a sealing member mounted in the decompression room and selectively abutting against the first end of the piston to selectively block the communication between inlet channel and the decompression room.

3. The compressed gas supplier as claimed in claim 2, wherein the piston has a head formed on the second end of the piston;

the decompression assembly comprises a pressure setting member mounted in the decompression room, clamped between the head of the piston and the sealing member to selectively block the communication between inlet channel and the decompression room.

4. The compressed gas supplier as claimed in claim 3, wherein the pressure setting member comprises:

an adjusting element selectively abutting against the sealing member to selectively block the communication between inlet channel and the decompression room; and a second resilient member clamped between adjusting element and the head of the piston to push the adjusting element to abut against the sealing member.

5. The compressed gas supplier as claimed in claim 2, wherein the sealing member comprises:

a washer selectively abutting against the first end of the piston to selectively block the communication between inlet channel and the decompression room; and a screw mounted through the housing, and holding the washer to selectively moves the washer axially.

6. The compressed gas supplier as claimed in claim 3, wherein the sealing member comprises:

a washer selectively abutting against the first end of the piston to selectively block the communication between inlet channel and the decompression room; and a screw mounted through the housing, and holding the washer to selectively moves the washer axially.

7. The compressed gas supplier as claimed in claim 4, wherein the sealing member comprises:

a washer selectively abutting against the first end of the piston to selectively block the communication between inlet channel and the decompression room; and a screw mounted through the housing, and holding the washer to selectively moves the washer axially.

8. The compressed gas supplier as claimed in claim 1, wherein the expansion chamber is defined in a bottle detachably connecting to the housing.

9. The compressed gas supplier as claimed in claim 1, wherein the expansion chamber is formed on the housing.

10. A compressed gas supplier comprising:

a power-free decompression device decompressing a gas in a high-pressure source into a decompressed gas and having a housing having an inlet connecting to the high-pressure source;

an outlet;

an inlet channel formed inside the housing and communicating with the inlet;

an outlet channel formed inside the housing and communicating with the outlet; and a releasing channel formed on the housing; and a decompression room formed inside the housing, and formed between and communicating with the inlet channel and the outlet channel;

an expansion chamber connecting to the power-free decompression device and receiving and storing the decompressed gas to adapted for selectively supplying the decompressed gas to the pneumatic tool, and having a first end;

a second end;

an entry formed on the first end of the expansion chamber; and a releasing hole formed on the first end of the expansion chamber and communicating with the releasing channel of the housing to adapted for connecting to the pneumatic tool; and an elongated tube connecting to and communicating with the outlet of the housing, protruding through the entry and protruding toward the second end of the expansion chamber.

11. The compressed gas supplier as claimed in claim 10, wherein the decompression assembly comprises:

a piston mounted slidably in the decompression room, selectively blocking the communication between inlet channel and the decompression room, and having a first end;

a second end; and a central opening formed through the first and second ends, selectively communicating with the inlet channel, and communicating with the outlet channel;

a first resilient element mounted in the decompression room and abutting against the second end of the piston to push the piston to slide away from the outlet channel; and a sealing member mounted in the decompression room and selectively abutting against the first end of the piston to selectively block the communication between inlet channel and the decompression room.

12. The compressed gas supplier as claimed in claim 11, wherein the piston has a head formed on the second end of the piston;

the decompression assembly comprises a pressure setting member mounted in the decompression room, clamped between the enlarged head of the piston and the sealing member to selectively block the communication between inlet channel and the decompression room and comprising an adjusting element selectively abutting against the sealing member to selectively block the communication between inlet channel and the decompression room; and a second resilient member clamped between adjusting element and the head of the piston to push the adjusting element to abut against the sealing member; and the sealing member comprises:

a washer selectively abutting against the first end of the piston to selectively block the communication between inlet channel and the decompression room; and a screw mounted through the housing, and holding the washer to selectively moves the washer axially.

* * * * *